US010589893B2

(12) United States Patent
Borek et al.

(10) Patent No.: US 10,589,893 B2
(45) Date of Patent: Mar. 17, 2020

(54) MULTI-SIDED REINFORCED CONTAINER

(71) Applicant: Georgia-Pacific Corrugated LLC, Atlanta, GA (US)

(72) Inventors: Richard Allen Borek, Sugar Hill, GA (US); James Brian Patterson, Waxahachie, TX (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 0 days.

(21) Appl. No.: 15/953,816

(22) Filed: Apr. 16, 2018

(65) Prior Publication Data

US 2018/0297745 A1 Oct. 18, 2018

Related U.S. Application Data

(60) Provisional application No. 62/486,076, filed on Apr. 17, 2017.

(51) Int. Cl.
*B65D 5/42* (2006.01)
*B65D 5/06* (2006.01)
(Continued)

(52) U.S. Cl.
CPC ..... *B65D 5/443* (2013.01); *B65D 5/029* (2013.01); *B65D 5/4266* (2013.01);
(Continued)

(58) Field of Classification Search
CPC .... B65D 5/4266; B65D 5/2033; B65D 5/443; B65D 5/0015; B65D 5/003; B65D 5/10; B65D 5/001
(Continued)

(56) References Cited

U.S. PATENT DOCUMENTS 2,114,052 A 4/1938 Kincade, Jr.
2,710,134 A 6/1955 Schroeder
(Continued)

FOREIGN PATENT DOCUMENTS

CA 2897154 A1 * 7/2014 ..... B65D 5/4266
EP 0468860 A 1/1992
(Continued)

OTHER PUBLICATIONS

PCT International Search Report and Written Opinion for PCT/US2018/054540 dated Dec. 14, 2018.
(Continued)

*Primary Examiner* — Nathan J Newhouse
*Assistant Examiner* — Phillip D Schmidt

(57) ABSTRACT

A multi-sided container has more than four sides and foldable panels integrally arranged with respect to each other. A first panel and a second panel form a contiguity with a first fold line disposed therebetween. The first panel and a third panel form a contiguity with a second fold line disposed therebetween. The third panel is not parallel with and not orthogonal to the first panel. A first strength reinforcement feature includes a first slot having a first planar edge oriented orthogonal to the first panel and orthogonal to a z-axis, and a second planar edge oriented orthogonal to the second panel and parallel to the z-axis. The third panel includes a cut edge proximate the first fold line having a third planar edge oriented orthogonal to the third panel and orthogonal to the z-axis. The third planar edge is disposed in a same plane as the first planar edge.

13 Claims, 6 Drawing Sheets

(51) Int. Cl.

| | |
|---|---|
| ***B65D 5/44*** | (2006.01) |
| ***B65D 5/02*** | (2006.01) |
| *B31B 50/14* | (2017.01) |
| *B31B 50/20* | (2017.01) |
| *B31B 120/00* | (2017.01) |
| *B31B 50/26* | (2017.01) |
| *B31B 100/00* | (2017.01) |
| *B31B 110/30* | (2017.01) |
| *B31B 120/10* | (2017.01) |
| *B31B 50/25* | (2017.01) |

(52) U.S. Cl.
CPC ..... *B31B 50/142* (2017.08); *B31B 50/20* (2017.08); *B31B 50/252* (2017.08); *B31B 50/26* (2017.08); *B31B 2100/0022* (2017.08); *B31B 2110/30* (2017.08); *B31B 2120/102* (2017.08); *B31B 2120/502* (2017.08)

(58) Field of Classification Search
USPC .... 229/109, 931, 915, 918, 920, 198.2, 164, 229/179
See application file for complete search history.

(56) References Cited

U.S. PATENT DOCUMENTS

| | | | | |
|---|---|---|---|---|
| 5,117,973 | A | 6/1992 | Lo Duca | |
| 6,106,450 | A | 8/2000 | Brittain | |
| 8,579,778 | B2 | 11/2013 | Aganovic et al. | |
| 8,851,362 | B2 | 10/2014 | Aksan et al. | |
| 9,815,585 | B2 | 11/2017 | Gasior et al. | |
| 2007/0228119 | A1* | 10/2007 | Barner | B65D 5/48014 229/109 |
| 2009/0098991 | A1 | 4/2009 | Graham | |
| 2010/0065620 | A1* | 3/2010 | Smith | B65D 5/029 229/109 |
| 2010/0219232 | A1 | 9/2010 | Smith | |
| 2011/0062223 | A1* | 3/2011 | Wall | B65D 77/068 229/109 |
| 2011/0204127 | A1 | 8/2011 | Brundage et al. | |
| 2011/0281705 | A1 | 11/2011 | Aganovic et al. | |
| 2012/0055922 | A1 | 3/2012 | Askan et al. | |
| 2013/0126594 | A1* | 5/2013 | Gasior | B65D 5/443 229/198.2 |
| 2015/0083788 | A1 | 3/2015 | Moreau et al. | |
| 2015/0115023 | A1 | 4/2015 | Brundage et al. | |
| 2016/0068298 | A1 | 3/2016 | Westney et al. | |

FOREIGN PATENT DOCUMENTS

| | | | |
|---|---|---|---|
| FR | 2196636 | A5 | 3/1974 |
| FR | 2240156 | A1 | 3/1975 |
| JP | 2014184967 | A | 10/2014 |
| JP | 2016069011 | A | 5/2016 |

OTHER PUBLICATIONS

International Search Report and Written Opinion mailed in international application No. PCT/US2011/050347 dated Mar. 19, 2012.
International Search Report and Written Opinion mailed in international application No. PCT/US2014/010587 dated May 14, 2014.
Extended European Search Report dated Jun. 11, 2015 in European patent application No. 11822726.3.
Extended European Search Report dated Mar. 29, 2018 for Application No. 17159609.1.
PCT International Search Report and Written Opinion for PCT/US2018/027726 dated Jul. 31, 2018.

* cited by examiner

MULTI-SIDED REINFORCED CONTAINER

CROSS REFERENCE TO RELATED APPLICATIONS

This application claims the benefit of U.S. Provisional Application Ser. No. 62/486,076, filed Apr. 17, 2017, which is incorporated herein by reference in its entirety.

BACKGROUND OF THE INVENTION

The subject matter disclosed herein relates to containers, particularly to packing containers, and more particularly to multi-sided reinforced packing containers suitably configured for stacking one on top of another and having more than four sides.

Packing containers are often formed from a corrugated sheet product material that is cut with a die to form a flat blank, or scored and slotted to form a flat blank. The flat blank is folded into a three-dimensional container that may be secured using an arrangement of flaps, adhesive liquids, staples or adhesive tapes.

In use, packing containers may be subjected to considerable forces during shipping, storage and stacking. While existing packing containers may be suitable for their intended purpose, the art relating to packing containers would be advanced with an increase in the strength and rigidity of packing containers, particularly with respect to stacking, while reducing the amount of materials used to form the packing containers.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment includes a multi-sided container having more than four sides and having a plurality of planar panels integrally arranged with respect to each other and with respect to a set of orthogonal x, y and z axes, the z-axis defining a direction line in which the container is configured to support a stacking load, the plurality of panels being foldable to create the multi-sided container having more than four sides. The plurality of planar panels include a first panel, a second panel, and a third panel, wherein the first panel and the second panel form a contiguity with a first fold line disposed therebetween, wherein the first panel and the third panel form a contiguity with a second fold line disposed therebetween, wherein the first panel is disposed parallel to the z-axis, the second panel is disposed orthogonal to the z-axis, and the third panel is disposed parallel to the z-axis, not parallel with the first panel, and not orthogonal to the first panel. A first strength reinforcement feature includes a first slot having a defined width with a first planar edge oriented orthogonal to the first panel and orthogonal to the z-axis, and a second planar edge oriented orthogonal to the second panel and parallel to the z-axis, the first planar edge being disposed parallel with and a distance away from the first fold line at a distance no greater than half a thickness of the first panel. The third panel includes a cut edge proximate the first fold line having a third planar edge oriented orthogonal to the third panel and orthogonal to the z-axis, the third planar edge being disposed a distance away from the first fold line at a distance no greater than half a thickness of the first panel. The third planar edge is disposed in a same plane as the first planar edge.

An embodiment includes a flat blank having a material composition and structural configuration sufficient to produce the aforementioned container.

The above features and advantages and other features and advantages of the invention are readily apparent from the following detailed description of the invention when taken in connection with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying non-limiting drawings in which like elements are numbered alike in the accompanying Figures where:

DETAILED DESCRIPTION OF THE INVENTION

Figure 1:
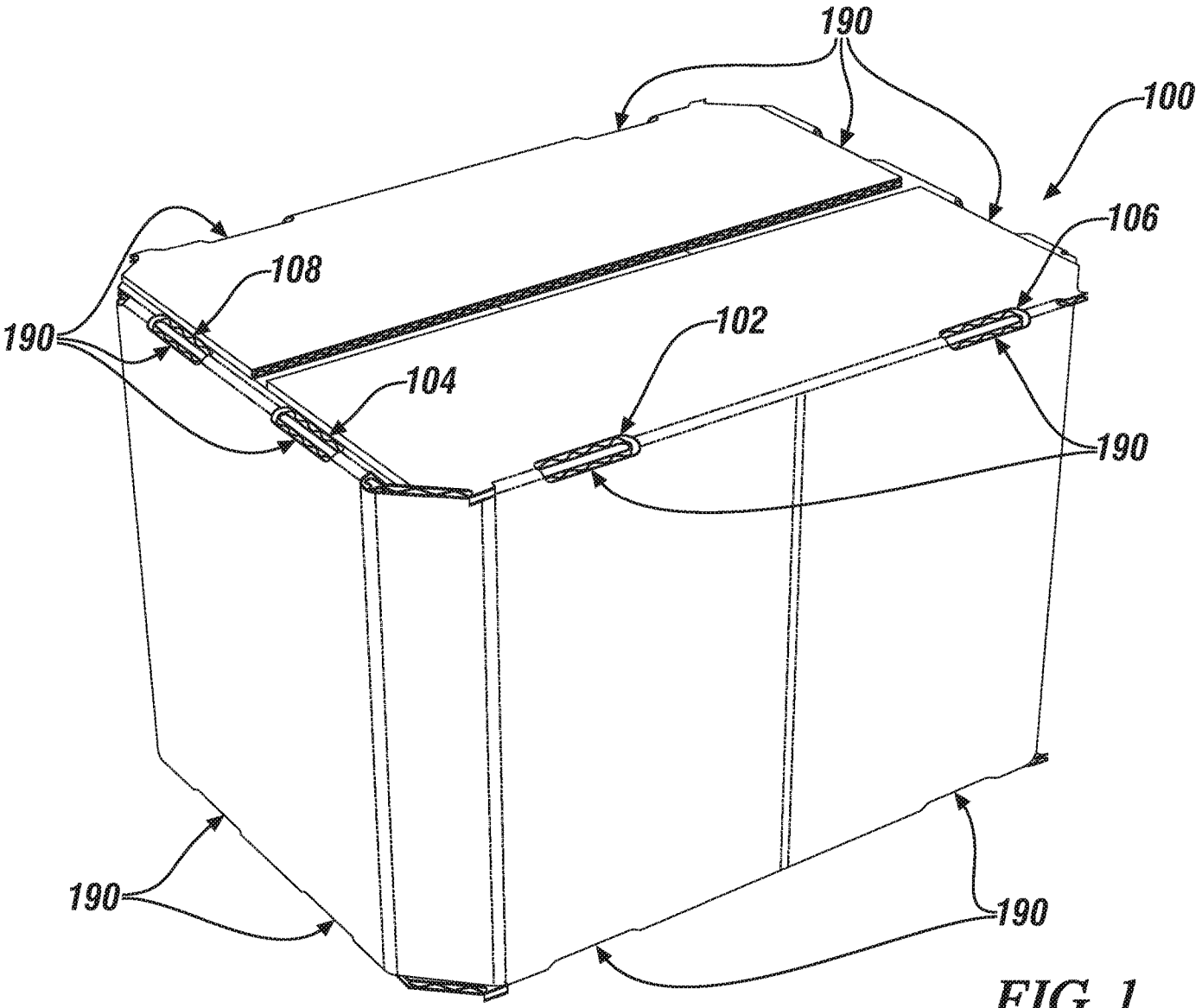
FIG. 1 depicts an example embodiment of an multi-sided container in accordance with an embodiment of the invention.

A packing container, also referred to as a carton or simply as a container, may be fabricated by, for example, cutting or scoring a sheet product with a die or other type of cutting or scoring tool, such as cutting, scoring and slotting tooling and equipment, to form a flat sheet having various panels, flaps, tabs, recesses and creases. The sheet may be folded and secured using, for example, adhesive liquids, tapes or mechanical means such as staples or straps to form a three-dimensional packing container. Packing containers may be formed from a variety of sheet products. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentangled (sometimes called spunlace), DRC (double re-creped), air laid, spunbond, carded, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Sheet product for packing containers may also include corrugated fiber board, which may be made from a variety of different flute configurations, such as A-flute, B-flute, C-flute, E-flute, F-flute, or micro-flute, for example. In an embodiment, a packing container as disclosed herein may be fabricated from a single piece of corrugated fiber board.

In use, a packing container may be subjected to various forces during handling, shipping and stacking of the packing container including, for example, compressive forces exerted between the top and bottom panels of the container. It is desirable for a packing container to withstand the various forces to protect objects in the container and to maintain a presentable appearance following shipping. It is also desirable to reduce the amount of materials used to form the packing container while maintaining design specifications for strength and rigidity.

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

An embodiment, as shown and described by the various figures and accompanying text, provides an engineered multi-sided package (container) having more than four sides and having at least one strength reinforcement feature, and typically several such strength reinforcement features, that provides improved compression reinforcement as compared to a similarly configured eight-sided container absent the same strength reinforcement features disclosed herein. While an embodiment described herein depicts an eight-sided container with a plurality of panels having certain structural dimensional relationships relative to each other as an exemplary multi-sided container, it will be appreciated that the disclosed invention is not so limited and is also applicable to other multi-sided containers having more than four sides, such as five, six, seven or eight sides, with a plurality of panels having different structural dimensional relationships relative to each other but consistent with an embodiment disclosed herein.

Figure 2:
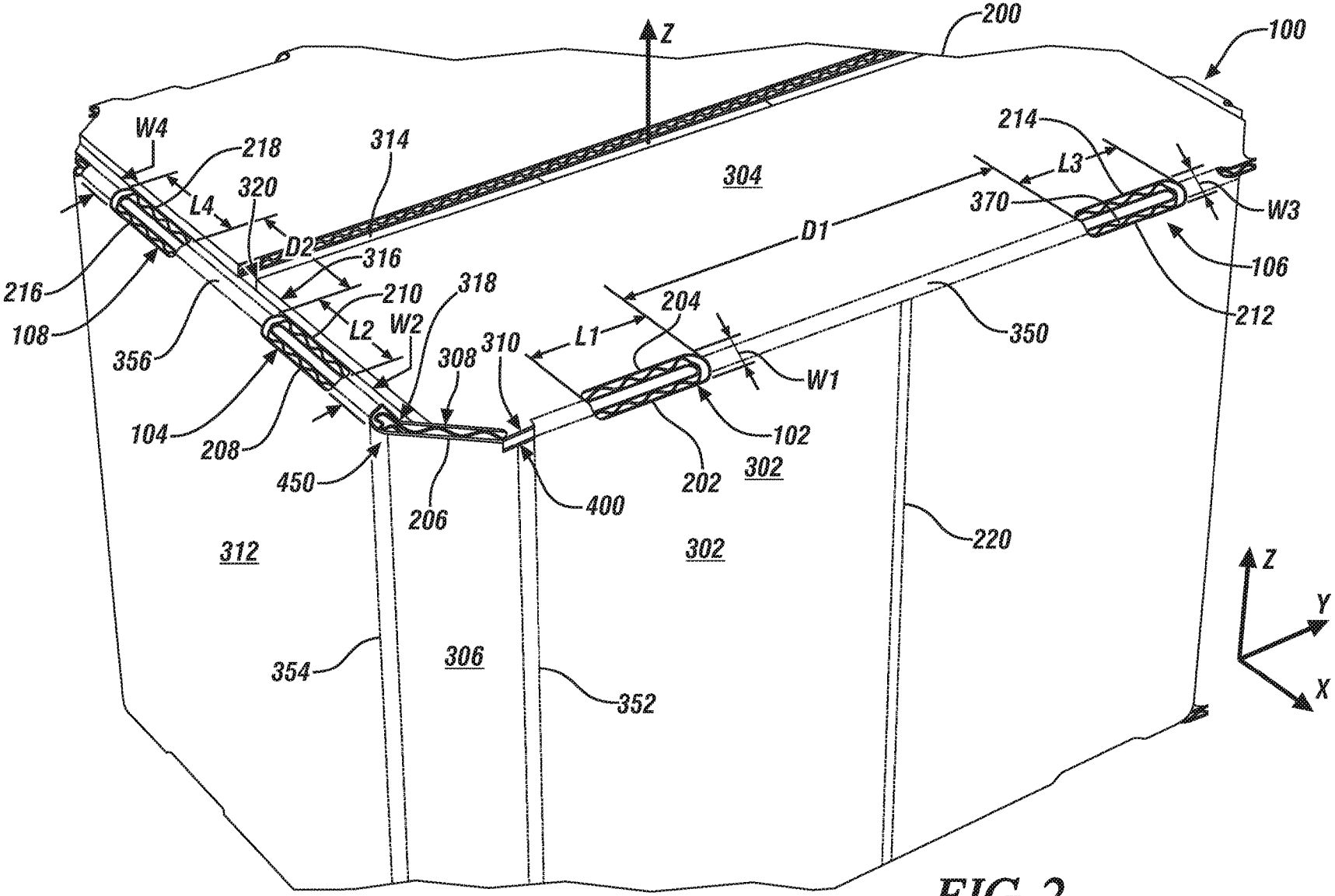
FIG. 2 depicts an expanded view of a portion of the multi-sided container of FIG. 1.
Figure 3:
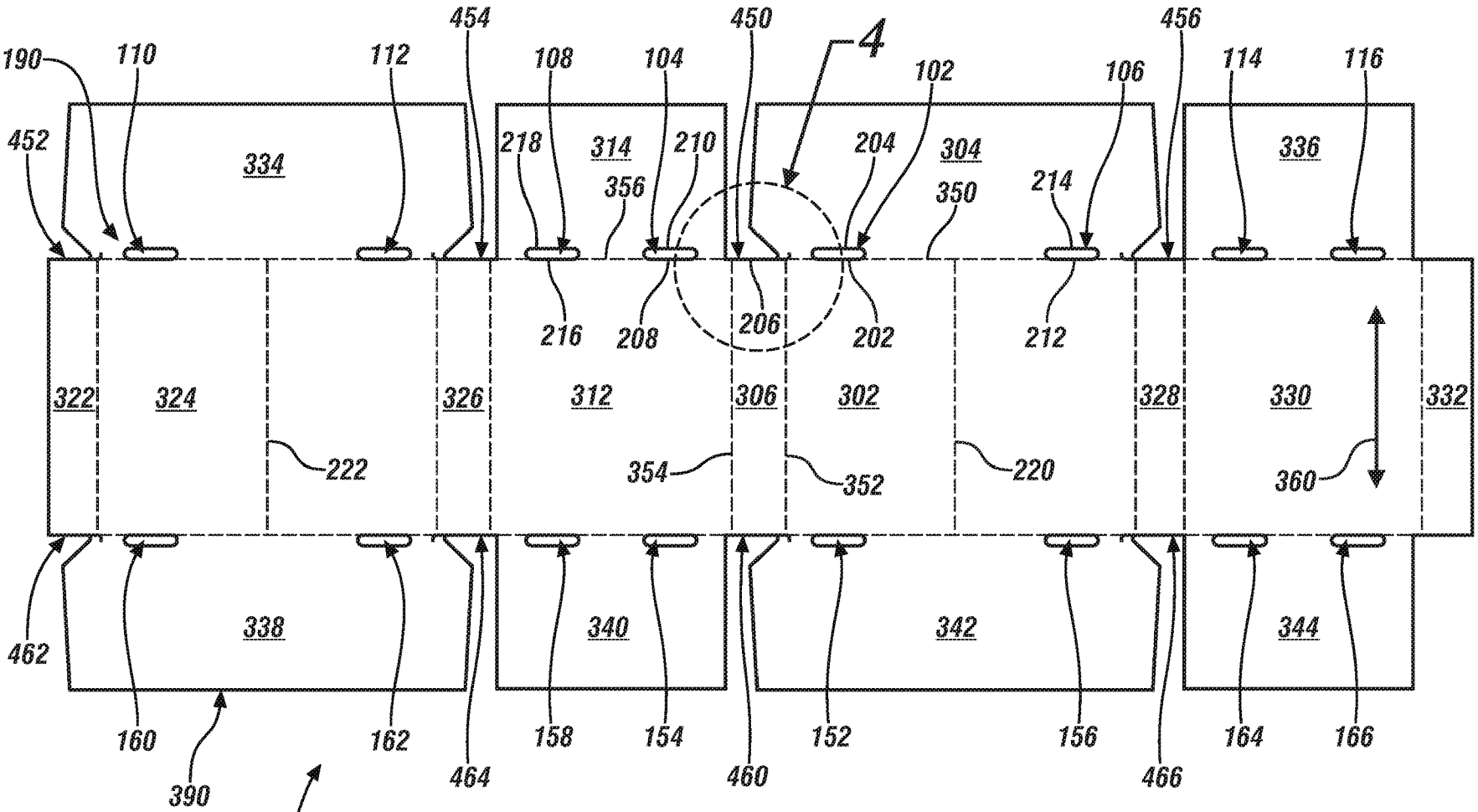
FIG. 3 depicts a flat blank suitable for forming the multi-sided container of FIG. 1 in accordance with an embodiment of the invention.
Figure 4:
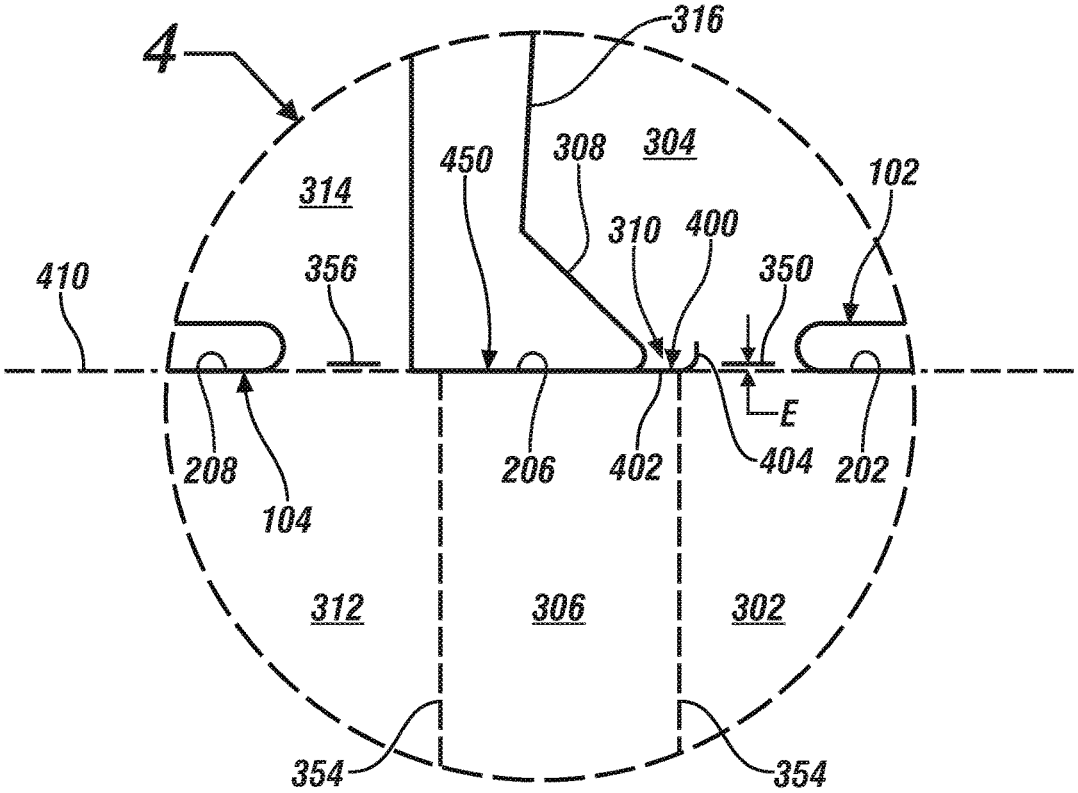
FIG. 4 depicts an expanded view of a portion of the flat blank of FIG. 3.

FIG. 1 depicts an example embodiment of an eight-sided container 100 consistent with an embodiment disclosed herein, FIG. 2 depicts an expanded view of a portion 200 of the eight-sided container 100 of FIG. 1, FIG. 3 depicts a flat blank 300 suitable for forming the eight-sided container 100 of FIG. 1, and FIG. 4 depicts an expanded view of a portion 400 of the flat blank 300 of FIG. 3. Reference will now be made to FIGS. 1-4 collectively.

In an embodiment, an eight-sided container 100 includes a plurality of planar panels 390 integrally arranged with respect to each other, via fold lines and/or score lines, and with respect to a set of orthogonal x, y and z axes, the z-axis defining a direction line in which the container 100 is configured to support a stacking load, the plurality of panels 390 being foldable to create the eight-sided container 100 having eight top edges and eight bottom edges as depicted. In an embodiment, the container 100 is fabricated from a corrugated fiber board with the central flutes 370 of the corrugation material oriented parallel with the z-axis (best seen with reference to FIG. 2). Direction line 360 depicted in FIG. 3 indicates the direction of the central flutes 370 and represents the feed direction of the corrugation material during fabrication of the flat blank 300.

In an embodiment the plurality of planar panels 390 includes a first panel 302, a second panel 304, and a third panel 306, wherein the first panel 302 and the second panel 304 form a contiguity with a first fold line 350 disposed therebetween, wherein the first panel 302 and the third panel 306 form a contiguity with a second fold line 352 disposed therebetween, wherein the first panel 302 is disposed parallel to the z-axis, the second panel 304 is disposed orthogonal to the z-axis, and the third panel 306 is disposed parallel to the z-axis, not parallel with the first panel 302, and not orthogonal to the first panel 302. In an embodiment, the third panel 306 is angled relative to the first panel 302 to form a 45-degree angled corner of the container 100.

The container 100 includes a plurality of strength reinforcement features (SRFs) 190 with each having a similar slotted shape, which will now be described in detail with respect to representative SRFs and their structural relationship to each other and to other features of the container 100. While not all SRFs 190 will be described individually, it will be appreciated that other SRFs 190 disclosed herein but not particularly enumerated in detail are similarly configured.

A first SRF 102 has a first slot (also herein referred to by reference numeral 102) having a defined width W1 and a defined length L1. The slot of SRF 102 has a first planar edge 202 oriented orthogonal to the first panel 302 and orthogonal to the z-axis, and a second planar edge 204 oriented orthogonal to the second panel 304 and parallel to the z-axis, the first planar edge 202 being disposed parallel with and a distance away from the first fold line 350 at a distance E no greater than half a thickness of the first panel 302 (best seen with reference to FIG. 4). In the art of corrugated fiber board the panel thickness is also referred to as the board caliper. The third panel 306 has a cut edge proximate the first fold line 350 that forms a third planar edge 206 oriented orthogonal to the third panel 306 and orthogonal to the z-axis, the third planar edge 206 being disposed a distance away from the first fold line 350 at a distance no greater than half a thickness of the first panel 302. The third planar edge 206 is disposed in a same plane 410 (best seen with reference to FIG. 4) as the first planar edge 202, for reasons that will be described further herein below.

With particular reference to FIG. 4, but with the same feature (described herein below) being depicted in other figures, an embodiment includes an extension cut line 400 that is a continuation of and extends from the cut edge (also herein referred to by reference numeral 206) of the third panel 306. The extension cut line 400 has a first through-cut portion 402 that extends from the cut edge 206 between the second panel 304 and the third panel 306 toward the first panel 302, and a second through-cut portion 404 that is a continuation of the first through-cut portion 402 and extends from the first panel 302 to the second panel 304 across the first fold line 350, wherein a first side portion 308 of the second panel 304 is disposed on top of the third planar edge 206 of the third panel 306. As noted above, the third planar edge 206 is disposed in a same plane as the first planar edge 202, which results in the third planar edge 206 providing a support surface for the first side portion 308 of the second panel 304 when the container 100 is folded as depicted in FIGS. 1 and 2. As can be seen in FIG. 4 the extension cut line 400 produces a support tab 310, when the container 100 is folded, that rests on top of the support surface provided by the third planar edge 206. The extension cut line 400 also provides the proper geometry for the first side portion 308 of the second panel 304 to rest on the third planar edge 206. A benefit of such an arrangement results when the container 100 has one or more other containers stacked on top of it, where the benefit is improved stacking strength, particularly at the corners of the container 100. As such, the extension cut line 400 in combination with the first side portion 308 and the third planar edge 206 also provides a strength reinforcement feature of the container 100, which is herein referred to as SRF2 and enumerated by reference numeral 450.

With reference now back to FIGS. 1-3, the plurality of planar panels 390 includes a fourth panel 312 and a fifth panel 314, wherein the fourth panel 312 and the third panel 306 form a contiguity with a third fold line 354 disposed therebetween, and wherein the fifth panel 314 and the fourth panel 312 form a contiguity with a fourth fold line 356 disposed therebetween. The fourth panel 312 is disposed parallel to the z-axis, and the fifth panel 314 is disposed orthogonal to the z-axis.

A second SRF 104 has a second slot (also herein referred to by reference numeral 104) having a defined width W2 and a defined length L2 with a fourth planar edge 208 oriented orthogonal to the fourth panel 312 and orthogonal to the z-axis, and a fifth planar edge 210 oriented orthogonal to the fifth panel 314 and parallel to the z-axis. The fourth planar edge 208 is disposed parallel with and a distance away from the fourth fold line 356 at a distance no greater than half a thickness of the fourth panel 312. In an embodiment, the fourth planar edge 208 is disposed in a same plane 410 (best seen with reference to FIG. 4) as the first planar edge 202 and the third planar edge 206, which is below the first fold line 350 and the fourth fold line 356 (best seen with reference to FIG. 4). In an embodiment, the third panel 306 forms a 45-degree angled corner between the first panel 302 and the fourth panel 312.

With particular reference now back to FIG. 2, an embodiment includes an arrangement where the second panel 304 has a second side portion 316 that is coextensive with and disposed at an angle relative to the first side portion 308. The second side portion 316 is also angled relative to the second slot 104 of the second strength reinforcement feature (also herein referred to by reference to numeral 104) such that a proximal end 318 of the second side portion 316 is disposed on top of the third planar edge 206 of the third panel 306, and a distal end 320 of the second side portion 316 is disposed in a manner and at a defined angle so as to leave the second slot 104 uncovered by the second side portion 316, as depicted in FIG. 2. A benefit of such an arrangement results when the container 100 has one or more other containers stacked on top of it, where the benefit is improved venting through an underlying stacked container 100, where the unobstructed venting provides for a reduced internal temperature of a given container via improved internal convective heat transfer.

With particular reference still to FIG. 2, an embodiment of the container 100 has a third SRF 106 with a third slot (also herein referred to by reference numeral 106) having a defined width W3 and a defined length L3 with a sixth planar edge 212 oriented orthogonal to the first panel 302 and orthogonal to the z-axis, and a seventh planar edge 214 oriented orthogonal to the second panel 304 and parallel to the z-axis. The sixth planar edge 212 is disposed parallel with and a distance away from the first fold line 350 at a distance no greater than half a thickness of the first panel 302. Additionally, an embodiment of the container 100 has a fourth SRF 108 having a fourth slot (also herein referred to by reference numeral 108) having a defined width W4 and a defined length L4 with eighth planar edge 216 oriented orthogonal to the fourth panel 312 and orthogonal to the z-axis, and a ninth planar edge 218 oriented orthogonal to the fifth panel 314 and parallel to the z-axis. The eighth planar edge 216 is disposed parallel with and a distance away from the fourth fold line 356 at a distance no greater than half a thickness of the fourth panel 312. In an embodiment, the sixth planar edge 212 and the eighth planar edge 216 are disposed in a same plane as the first planar edge 202, the third planar edge 206, and the fourth planar edge 208.

In an embodiment, the first slot 102 and the third slot 106 have a defined distance D1 therebetween, and the second slot 104 and the fourth slot 108, have a defined distance D2 therebetween, where the ratios of D1/L1, D1/L3, D2/L2 and D2/L4 are each equal to or greater than one. In an embodiment L1=L2=L3=L4. In an embodiment W1=W2=W3=W4.

In addition to the foregoing described strength reinforcement features noted as SRF and SRF2 and with reference to FIGS. 2 and 3, an embodiment of container 100 includes an additional strength reinforcement feature formed by a vertical score or fold line 220 extending from a bottom to a top of the first panel 302 parallel to the z-axis, which is herein referred to as SRF3 and enumerated by reference numeral 220. The additional strength reinforcement feature SRF3 220 subdivides the first panel 302 without the SRF3 220 extending beyond outer or inner surfaces of the first panel 302.

As noted herein above, not all SRFs 190 have been described individually, but it will be appreciated that other SRFs 190 disclosed or illustrated herein but not particularly enumerated in detail are similarly configured. That said, and for completeness of disclosure, reference is now made to FIGS. 1 and 3, which depict a plurality of other SRFs 190 enumerated as 102, 104, 106, 108, 110, 112, 114 and 116 on the upper end of container 100, and SRFs 190 enumerated as 152, 154, 156, 158, 160, 162, 164 and 166 on the lower end of container 100. Furthermore, an embodiment includes a plurality of SRF2's enumerated as 450, 452, 454 and 456 on the upper end of container 100, and SRF2's enumerated as 460, 462, 464 and 466 on the lower end of container 100. Yet furthermore, an embodiment includes a plurality of SRF3's enumerated as 220 and 222.

From the foregoing description of the container 100, and with particular reference to FIG. 3, it will be appreciated that an embodiment of the invention disclosed herein includes a flat blank 300 having a material composition and a structural configuration sufficient to produce the container 100 disclosed herein. As depicted in FIG. 3 the flat blank 300 includes panels 322, 324, 326, 328, 330, 332, 334, 336, 338, 340, 342 and 344, in addition to the previously described panels 302, 304, 306, 312 and 314, all of which forming a single contiguity with associated fold lines disposed between adjacent panels. While each panel has not herein been described in exhaustive detail it will be appreciated by one skilled in the art from the detailed description herein how the plurality of panels 390 are folded to form the container 100 having the structural reinforcement features distributed as described and illustrated herein.

In an embodiment, the flat blank 300 is fabricated according to a process that includes cutting or partially cutting the corrugated fiber material to produce cuts (depicted as solid lines in FIG. 3) productive of the plurality of planar panels 190, creasing or partially creasing the corrugated fiber material to produce creases (depicted as dashed lines in FIG. 3) productive of the plurality of planar panels 190, scoring or partially scoring the corrugated fiber material to produce scores (depicted by enumerated features 220, 222 in FIG. 3) productive of the plurality of planar panels 190, or any combination of the foregoing cuts, creases or scores, and employing a stamp die or a rotary die that enables all cuts, creases and scores to be completed in one machine operation, such as one cyclical stamp of the stamp die or one cyclical rotation of the rotary die. A benefit of such a process involving a single machine operation to produce the flat blank 300 is improved dimensional control between the several strength reinforcement features, which not only yields a container 100 having improved compression strength, but also yields a container 100 having improved uniform strength as the loading force increases from the weight of stacked containers.

Figure 5:
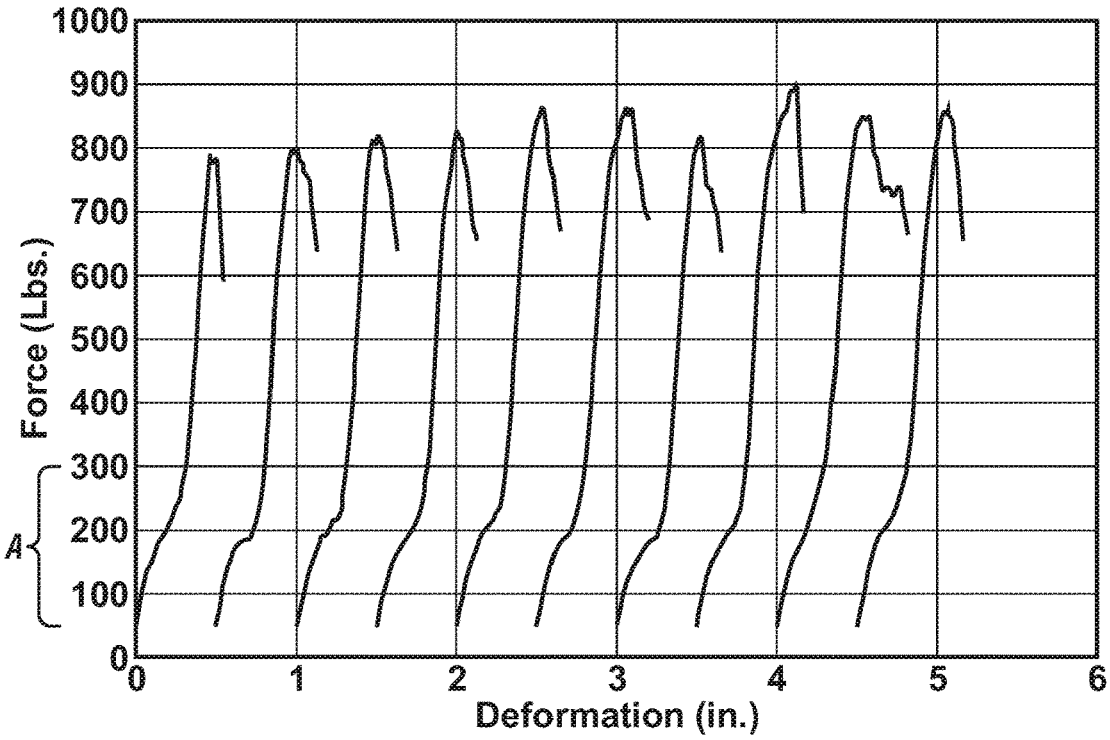
FIG. 5 depicts a plurality of force versus deformation plots for a reference container.
Figure 6:
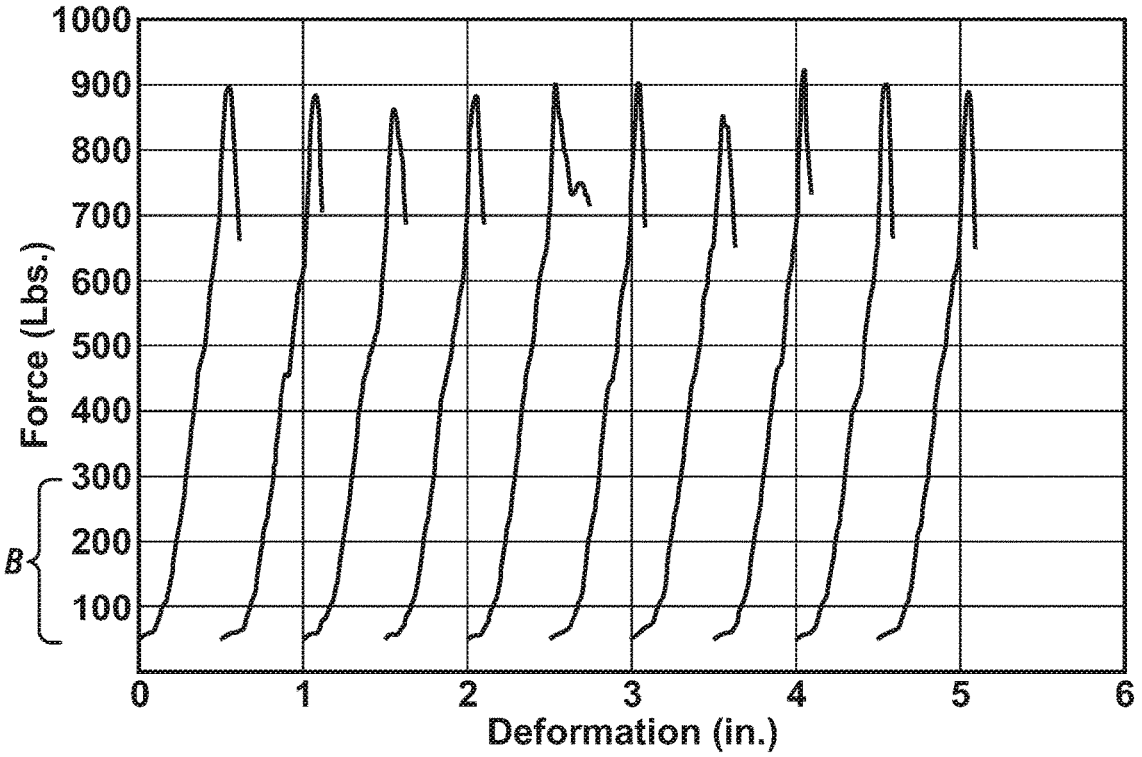
FIG. 6 depicts a plurality of force versus deformation plots for a container in accordance with an embodiment of the invention.

The improved compression strength, and uniformed deflection curves during load, can be seen with reference to FIGS. 5 and 6, where each figure depicts ten profiles of force (pounds) versus deformation (inches) curves of two eight-sided containers similar to that described and illustrated herein, but where the containers differ in that the container tested with the FIG. 5 results is absent the strength reinforcement features SRF, SRF2 and SRF3 disclosed herein, and where the container tested with the FIG. 6 results includes the strength reinforcement features SRF, SRF2 and SRF3 disclosed herein.

The profiles in FIG. 5 have: a maximum force peak of 899.9 pounds; a maximum deformation peak of 0.62 inches; a minimum force peak of 788.3 pounds; a minimum deformation peak of 0.463 inches; an average force peak of 838.52 pounds; an average deformation peak of 0.5351 inches; a force standard deviation of 32.241 pounds; and, a deformation standard deviation of 0.041 inches.

The profiles in FIG. 6 have: a maximum force peak of 924 pounds; a maximum deformation peak of 0.545 inches; a minimum force peak of 851.3 pounds; a minimum deformation peak of 0.554 inches; an average force peak of 889.98 pounds; an average deformation peak of 0.55 inches; a force standard deviation of 19.842 pounds; and, a deformation standard deviation of 0.010 inches.

As seen by comparing the peaks of the ten test runs between FIGS. 5 and 6, the compression strength of the container tested in FIG. 6 (with SRF's) are consistently higher than that of the container tested in FIG. 5 (absent SRF's), with the average force peak increasing by more than 50 pounds from the container of FIG. 5 to the container of FIG. 6. And, as seen by comparing the slopes, see particularly regions "A" and "B", of the ten test runs between FIGS. 5 and 6, the uniformity of the container strength during loading is more uniform in the container tested in FIG. 6 (with SRF's) than the container tested in FIG. 5 (absent SRF's), which is notable by the more uniform upward slope of the test curves of FIG. 6. A container having improved uniform compression strength during loading is desirable to avoid partial buckling in different regions of the container.

Figure 7:
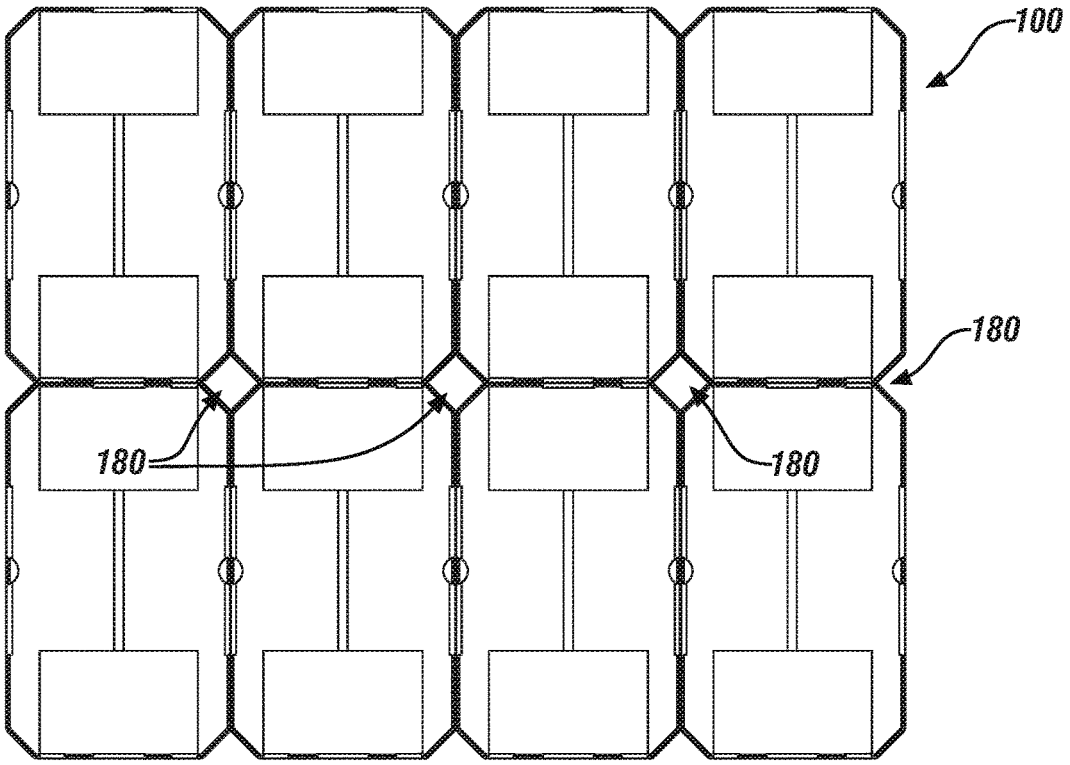
FIGS. 7 and 8 depict plan views of two pallet pattern arrangements of a plurality of eight-sided containers in accordance with an embodiment of the invention.
Figure 8:
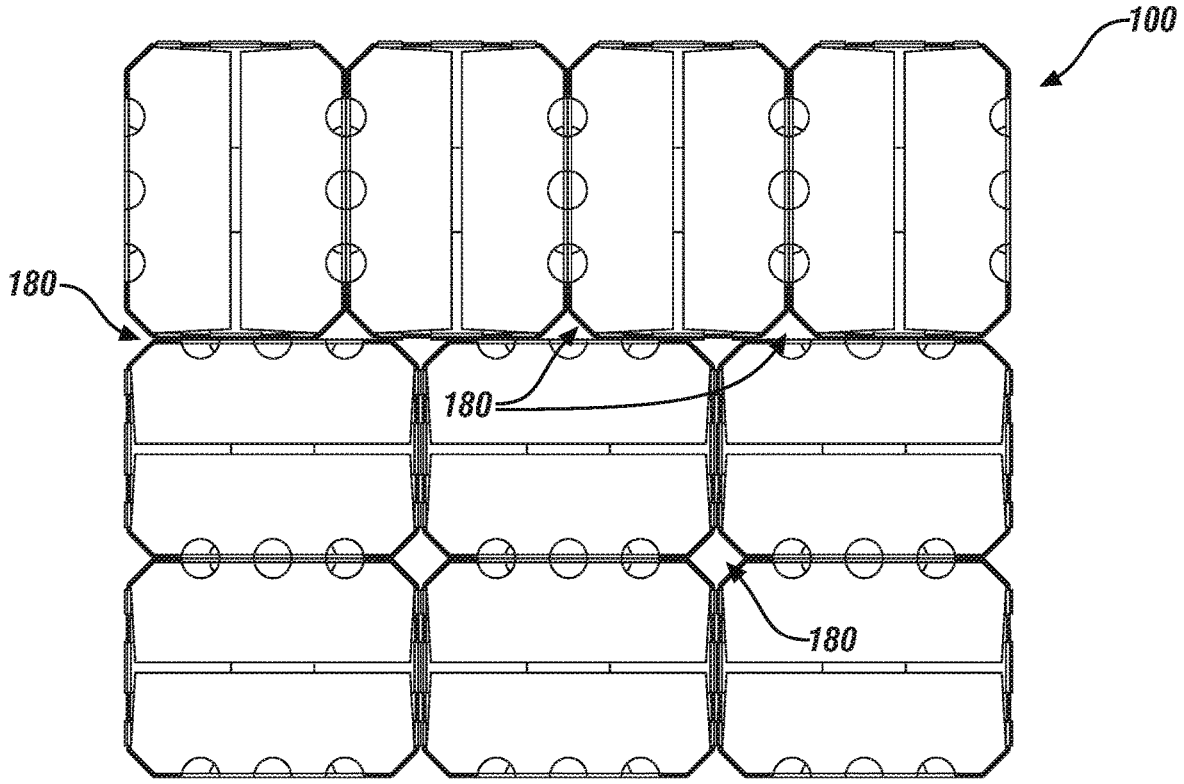

Reference is now made to FIGS. 7 and 8, which depict plan views of two pallet pattern arrangements of a plurality of eight-sided containers 100. As can be seen, the corner panels, third panel 306 depicted in FIG. 2 for example, create cooling channels 180 between layers of similarly stacked eight-sided containers 100. Empirical temperature test results show that the internal ambient temperature of an eight-sided container as disclosed herein, having external cooling channels formed by the corner panels and stacked as shown in either FIG. 7 or FIG. 8, is lower than that of a conventional four-sided container of similar size and stacking but absent the herein noted external cooling channels.

Figure 9:
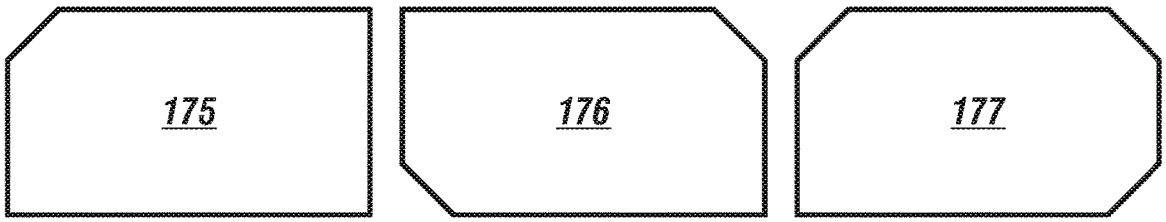
FIG. 9 depicts plan views of three other container arrangements, having five, six and seven sides, in accordance with an embodiment of the invention.

FIG. 9 depicts plan views of three other container arrangements, having five 175, six 176 and seven 177 sides, all of which are contemplated herein and considered within a scope of the invention disclosed herein.

It has been found through empirical compression testing that a multi-sided container having more than four sides, and having the SRF2's alone or in combination with the SRF's and/or the SRF3's as herein disclosed, provides a container having improved stacking compression strength as compared to a similarly shaped and sized control sample container absent the SRF2's. Stated alternatively, it has been found that inclusion of the SRF2's as herein disclosed provides a not insubstantial incremental improvement in the stacking compression strength of the multi-sided container equipped with such SRF2's.

As used herein, the terms orthogonal (perpendicular) and parallel should be interpreted as being substantially orthogonal (perpendicular) and substantially parallel, respectively. For example, the term orthogonal in relation to planar surfaces should be interpreted to include two planar surfaces having an angle therebetween from 85-degrees to 95-degrees, or more typically from 88-degrees to 92-degrees, depending on whether the measurement is taken when the container is in a non-compressed state or a compressed state. And the term parallel in relation to planar surfaces should be interpreted to include two planar surfaces having an angle therebetween from +5-degrees to −5-degrees, or more typically from +2-degrees to −2-degrees, depending on whether the measurement is taken when the container is in a non-compressed state or a compressed state.

As used herein, any reference to a dimension or a percentage value should not be construed to be the exact dimension or percentage value stated, but instead should be understood to mean a dimension or percentage value that is "about" the stated dimension or percentage value so to accommodate dimensional tolerances, except where it is clear from the description and usage as presented herein.

While the invention has been described with reference to example embodiments, it will be understood by those skilled in the art that various changes may be made and equivalents may be substituted for elements thereof without departing from the scope of the claims. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed example embodiments and, although specific terms and/or dimensions may have been employed, they are unless otherwise stated used in a generic, example and/or descriptive sense only and not for purposes of limitation, the scope of the claims therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Additionally, the term "comprising" as used herein does not exclude the possible inclusion of one or more additional features.

What is claimed is:

1. A multi-sided container having more than four sides, comprising:

a plurality of planar panels integrally arranged with respect to each other and with respect to a set of orthogonal x, y and z axes, the z-axis defining a direction line in which the container is configured to support a stacking load, the plurality of panels being foldable to create the multi-sided container having more than four sides;

the plurality of planar panels comprising a first panel, a second panel, and a third panel, wherein the first panel and the second panel form a contiguity with a first fold line disposed therebetween, wherein the first panel and the third panel form a contiguity with a second fold line disposed therebetween, wherein the first panel is disposed parallel to the z-axis, the second panel is disposed orthogonal to the z-axis, and the third panel is disposed parallel to the z-axis, not parallel with the first panel, and not orthogonal to the first panel;

a first strength reinforcement feature comprising a first slot having a defined width with a first planar edge oriented orthogonal to the first panel and orthogonal to the z-axis, and a second planar edge oriented orthogonal to the second panel and parallel to the z-axis, the first planar edge being disposed parallel with and a distance away from the first fold line at a distance no greater than half a thickness of the first panel;

the third panel comprising a cut edge proximate the first fold line having a third planar edge oriented orthogonal to the third panel and orthogonal to the z-axis, the third planar edge being disposed a distance away from the first fold line at a distance no greater than half a thickness of the first panel;

the third planar edge being disposed in a same plane as the first planar edge.

2. The container of claim 1, further comprising:

an extension cut line that is a continuation of and extends from the cut edge of the third panel, the extension cut line comprising a first through-cut portion that extends from the cut edge between the second panel and the third panel toward the first panel, and a second through-cut portion that is a continuation of the first through-cut portion and extends from the first panel to the second panel across the first fold line;

wherein a first side portion of the second panel is disposed on top of the third planar edge of the third panel.

3. The container of claim 2, wherein:

the plurality of planar panels further comprises a fourth panel and a fifth panel, wherein the fourth panel and the third panel form a contiguity with a third fold line disposed therebetween, wherein the fifth panel and the fourth panel form a contiguity with a fourth fold line disposed therebetween, wherein the fourth panel is disposed parallel to the z-axis, wherein the fifth panel is disposed orthogonal to the z-axis;

and further comprising a second strength reinforcement feature comprising a second slot having a defined width with a fourth planar edge oriented orthogonal to the fourth panel and orthogonal to the z-axis, and a fifth planar edge oriented orthogonal to the fifth panel and parallel to the z-axis, the fourth planar edge being disposed parallel with and a distance away from the fourth fold line at a distance no greater than half a thickness of the fourth panel.

4. The container of claim 3, wherein the fourth planar edge is disposed in a same plane as the first planar edge and the third planar edge.

5. The container of claim 4, wherein a second side portion of the second panel is angled relative to the second slot of the second strength reinforcement feature such that a proximal end of the second side portion is disposed on top of the third planar edge of the third panel, and a distal end of the second side portion is disposed in a manner so as to leave the second slot uncovered by the second side portion.

6. The container of claim 5, further comprising:

a third strength reinforcement feature comprising a third slot having a defined width with a sixth planar edge oriented orthogonal to the first panel and orthogonal to the z-axis, and a seventh planar edge oriented orthogonal to the second panel and parallel to the z-axis, the sixth planar edge being disposed parallel with and a distance away from the first fold line at a distance no greater than half a thickness of the first panel; and a fourth strength reinforcement feature comprising a fourth slot having a defined width with eighth planar edge oriented orthogonal to the fourth panel and orthogonal to the z-axis, and a ninth planar edge oriented orthogonal to the fifth panel and parallel to the z-axis, the eighth planar edge being disposed parallel with and a distance away from the fourth fold line at a distance no greater than half a thickness of the fourth panel.

7. The container of claim 6, wherein the sixth planar edge and the eighth planar edge are disposed in a same plane as the first planar edge, the third planar edge, and the fourth planar edge.

8. The container of claim 7, wherein:

the first slot, the second slot, the third slot and the fourth slot have defined slot lengths L1, L2, L3, L4, respectively;

the first slot and the third slot, and the second slot and the fourth slot, have a defined distance D1, D2 therebetween, respectively; and ratios of D1/L1, D1/L2, D2/L3 and D2/L4 are each equal to or greater than one.

9. The container of claim 5, wherein:

the plurality of planar panels are fabricated from a corrugated fiber material with the corrugations oriented parallel to the z-axis.

10. The container of claim 9, further comprising:

an additional strength reinforcement feature comprising a vertical score or fold line extending from a bottom to a top of the first panel parallel to the z-axis;

wherein the additional strength reinforcement feature subdivides the first panel without the additional strength reinforcement feature extending beyond outer or inner surfaces of the first panel.

11. The container of claim 2, wherein the plurality of planar panels are fabricated from a single piece of corrugated fiber board with the corrugations oriented parallel to the z-axis.

12. The container of claim 10 fabricated according to a process comprising:

cutting or partially cutting the corrugated fiber material to produce cuts productive of the plurality of planar panels, creasing or partially creasing the corrugated fiber material to produce creases productive of the plurality of planar panels, scoring or partially scoring the corrugated fiber material to produce scores productive of the plurality of planar panels, or any combination of the foregoing cuts, creases or scores, and employing a stamp die or a rotary die that enables all cuts, creases and scores to be completed in one machine operation, such as one cyclical stamp of the stamp die or one cyclical rotation of the rotary die.

13. A flat blank having a material composition and structural configuration sufficient to produce the container according to claim 10.

* * * * *